US011223137B2

(12) United States Patent
Yanagi et al.

(10) Patent No.: US 11,223,137 B2
(45) Date of Patent: Jan. 11, 2022

(54) ARRAY ANTENNA DEVICE

(71) Applicant: Mitsubishi Electric Corporation, Tokyo (JP)

(72) Inventors: Takashi Yanagi, Tokyo (JP); Kiyotaka Suzuki, Tokyo (JP); Hidetoshi Makimura, Tokyo (JP); Yasuhiro Nishioka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/966,993

(22) PCT Filed: Feb. 23, 2018

(86) PCT No.: PCT/JP2018/006614
§ 371 (c)(1),
(2) Date: Aug. 3, 2020

(87) PCT Pub. No.: WO2019/163071
PCT Pub. Date: Aug. 29, 2019

(65) Prior Publication Data

US 2021/0044023 A1 Feb. 11, 2021

(51) Int. Cl.
*H01Q 11/08* (2006.01)
*H01Q 21/06* (2006.01)
(Continued)

(52) U.S. Cl.
CPC ..... *H01Q 11/08* (2013.01); *H01Q 3/2605* (2013.01); *H01Q 3/32* (2013.01); *H01Q 21/0031* (2013.01); *H01Q 21/08* (2013.01)

(58) Field of Classification Search
CPC .... H01Q 11/08; H01Q 21/00; H01Q 21/0031; H01Q 1/52; H01Q 21/06; H01Q 21/08; H01Q 3/26; H01Q 3/2605; H01Q 3/32
See application file for complete search history.

(56) References Cited

U.S. PATENT DOCUMENTS 2,981,949 A * 4/1961 Elliott ..... H01Q 3/14 343/771
3,022,506 A * 2/1962 Goebels, Jr. ..... H01Q 21/245 343/771
(Continued)

FOREIGN PATENT DOCUMENTS

JP 6-310930 A 11/1994
JP 10-135734 A 5/1998
JP 11-308019 A 11/1999

OTHER PUBLICATIONS

International Search Report issued in PCT/JP2018/006614 (PCT/ISA/210), dated May 15, 2018.

*Primary Examiner* — Tho G Phan
(74) *Attorney, Agent, or Firm* — Birch, Stewart, Kolasch & Birch, LLP

(57) ABSTRACT

The present invention provides an antenna device including a ground conductor plate 1 having a first circular hole 6, a disc-shaped conductor plate 5 which has a second circular hole 7 whose center is disposed on a straight line passing through a center of the first hole 6 and orthogonal to the ground conductor plate 1, has a center that coincides with the center of the second hole 7, and is disposed substantially parallel to the ground conductor plate 1, a first linear conductor 4 having a first end passing through the first hole and a second end passing through the second hole, a second linear conductor 3 having a first end connected to the second end of the first conductor and disposed substantially parallel to the ground conductor plate, and an antenna element 2 connected to a second end of the second conductor.

1 Claim, 10 Drawing Sheets

(51) Int. Cl.

| | |
|---|---|
| ***H01Q 21/08*** | (2006.01) |
| ***H01Q 3/26*** | (2006.01) |
| ***H01Q 3/32*** | (2006.01) |
| ***H01Q 21/00*** | (2006.01) |

(56) References Cited

U.S. PATENT DOCUMENTS 5,453,755 A * 9/1995 Nakano ..... H01Q 11/08
343/872
5,699,072 A * 12/1997 Tokuda ..... H01Q 1/247
343/786
6,115,005 A * 9/2000 Goldstein ..... H01Q 1/36
343/895

* cited by examiner

ARRAY ANTENNA DEVICE

TECHNICAL FIELD

The present invention relates to a circular polarization element antenna.

BACKGROUND ART

In wireless communication, to enable efficient transmission and reception, it is necessary to match polarization planes of a transmission antenna and a receiving antenna. Therefore, when an artificial satellite rotates and a polarization plane of an antenna cannot be determined as in satellite communication, a circularly polarized wave is often used. A helical antenna is one of antenna elements that can excite a circularly polarized wave. The helical antenna is an antenna having a shape formed by helically winding a conductor. It can excite a circularly polarized wave with a simple configuration without using a circularly polarized wave excitation circuit, and is widely used in satellite communication antennas and the like.

For feeding power to the helical antenna, a method is often used in which the end of the linear conductor constituting a helical antenna element is passed through a hole provided in a ground conductor to form a coaxial line and connected to a power feeding circuit (for example, a waveguide). However, if the space between the helical antenna element and the ground conductor is small, the electromagnetic coupling between the two changes the circular polarization characteristics (axial ratio) of the helical antenna. For this reason, there have been problems that the use is limited to a frequency at which the manufacturing tolerance does not cause a problem, and that the yield is deteriorated.

Patent Literature 1 discloses a practical method of a helical antenna. In Patent Literature 1, a helical antenna is added via a capacitive element to the end of a power feeding pin that supplies a high-frequency current to a microstrip antenna.

CITATION LIST

Patent Literature

Patent Literature 1: JP-A-10-135734

SUMMARY OF INVENTION

Technical Problem

Since the helical antenna of Patent Literature 1 is configured as described above, it is possible to reduce cross-interference with the microstrip antenna and obtain a favorable circularly polarized wave. However, the influence on the circular polarization characteristics (axial ratio) cannot be reduced for the fact that the interval between the helical antenna and the microstrip antenna changes due to manufacturing tolerance. Therefore, there are problems that the yield is deteriorated and that a new support structure for fixing the helical antenna element needs to be provided in order to reduce the manufacturing tolerance.

The present invention has been made to solve the above-described problems, and has an object to obtain an antenna device in which a change in circular polarization characteristics is small with respect to a distance between a helical antenna element and a ground conductor.

Solution to Problem

An array antenna device according to the present invention includes a waveguide having a plurality of first circular holes provided in a first surface, and a plurality of connection shaft insertion holes provided in a second surface facing the first surface; a plurality of first linear conductors respectively inserted into the plurality of first holes so that first ends are arranged inside the waveguide and second ends are arranged outside the waveguide; a plurality of disc-shaped conductor plates each having a second circular hole and disposed substantially parallel to the first surface outside the waveguide so that the plurality of first linear conductors are respectively inserted into the second holes; a plurality of second linear conductors having first ends respectively connected to second ends of the plurality of first linear conductors and arranged substantially parallel to the first surface; a plurality of antenna elements respectively connected to second ends of the plurality of second linear conductors; a plurality of connection shafts respectively inserted into the plurality of connection shaft insertion holes and having first ends respectively connected to first ends of the plurality of first linear conductors; a plurality of rotation devices for rotating each of the plurality of connection shafts; and a control device for individually controlling rotation of the plurality of rotation devices.

Advantageous Effects of Invention

According to the present invention, it is possible to obtain an antenna device having a small change in circular polarization characteristics with respect to the distance between a helical antenna element and a ground conductor.

DESCRIPTION OF EMBODIMENTS

Hereinafter, embodiments of the present invention will be described in detail with reference to the drawings.

First Embodiment

Figure 1:
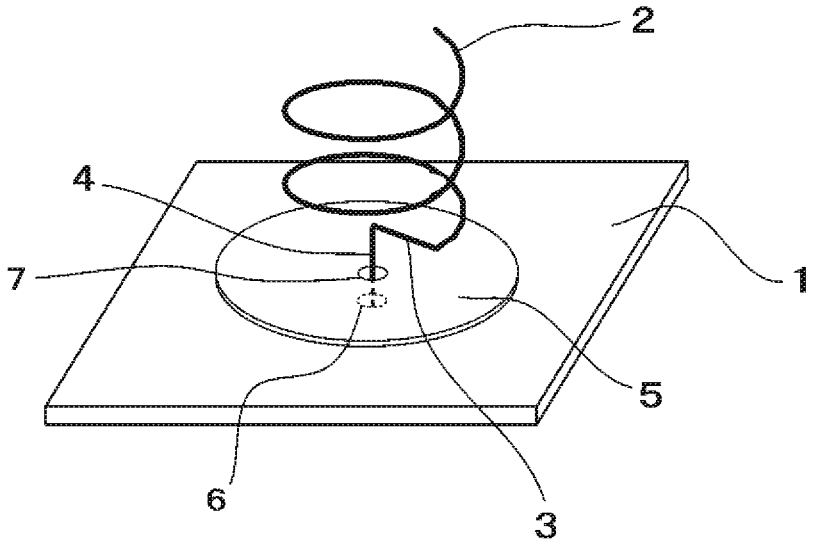
FIG. 1 is a configuration diagram illustrating an antenna device according to a first embodiment.

FIG. 1 is a configuration diagram illustrating an antenna device according to a first embodiment of the present invention. In FIG. 1, reference numeral 1 is a ground conductor (ground conductor plate), 2 is a circular polarization element antenna (antenna element), 3 is a horizontal conductor (second conductor), 4 is a vertical conductor (first conductor), 5 is a disk (conductor plate), 6 is a first hole provided in the ground conductor 1, and 7 is a second hole provided in the disk 5.

Figure 2:
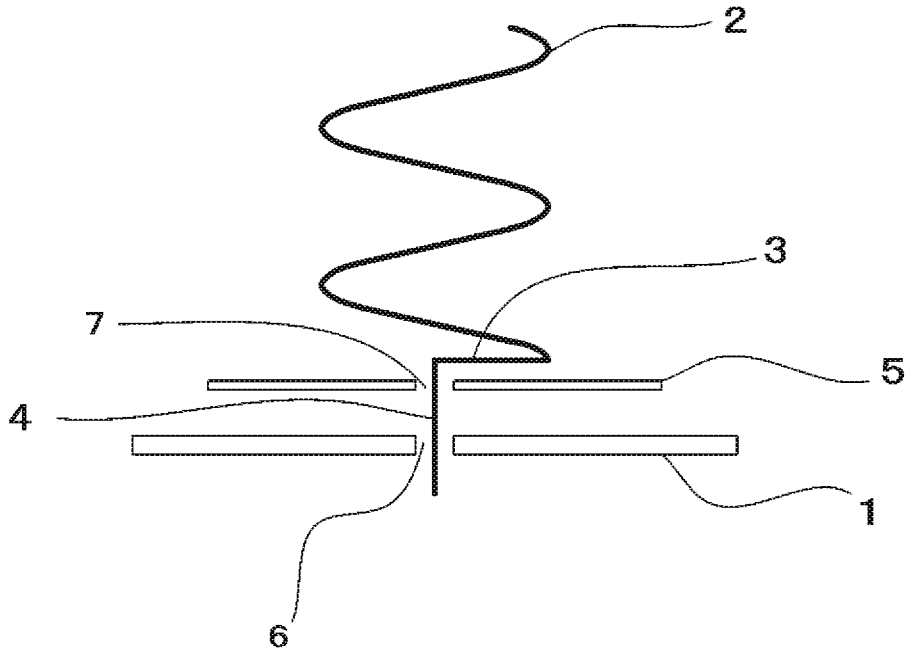
FIG. 2 is a cross-sectional view illustrating the antenna device according to the first embodiment.

FIG. 2 is a cross-sectional view of a plane including the vertical conductor 4 and perpendicular to the ground conductor 1.

The ground conductor 1 is made of a metal such as copper or aluminum and operates as a ground of the antenna device. In the present embodiment, as illustrated in FIGS. 1 and 2, the ground conductor 1 is illustrated as a rectangular plate, but an arbitrary shape may be appropriately selected as long as operation as a ground of the antenna device is obtained. For example, it may be circular.

A power feeding line (not illustrated) is provided on a surface opposite to the surface of the ground conductor 1 on which the circular polarization element antenna (antenna element) 2 is provided.

The circular polarization element antenna 2 is an antenna that transmits or receives a circularly polarized wave. In the present embodiment, as illustrated in FIGS. 1 and 2, a helical antenna having a structure in which a linear conductor is helically wound around the side of the shaft with respect to the axis in the direction of transmitting or receiving a circularly polarized wave is taken as an example. However, a curled antenna or a spiral antenna in which a linear conductor is wound in a circular shape perpendicular to the axis may be used.

The diameter, pitch, and number of turns of the circular polarization element antenna 2 are designed so that a good circularly polarized wave is radiated at a desired frequency.

The horizontal conductor 3 is a linear conductor, one end of which is connected to the lower end of the circular polarization element antenna 2 and the other end of which is connected to the vertical conductor 4 so that it is disposed to be parallel to the ground conductor 1 above the ground conductor 1.

The vertical conductor 4 is a linear conductor and is disposed passing through the first hole 6 and the second hole 7 so that one end is connected to the horizontal conductor 3 and the other end is connected to a power feeding line (not illustrated). Note that the central axis of the vertical conductor 4 coincides with the central axis of the circular polarization element antenna 2.

The disk 5 is a plate-like conductor plate disposed parallel to the ground conductor 1. The center of the disk 5 coincides with the central axis of the vertical conductor 4. The disk 5 is fixed to the vertical conductor 4 so that the distance to the horizontal conductors 3 is constant. At this time, the disk 5 is fixed in such a manner that it is not electrically connected to the vertical conductor 4.

The radius of the disk 5 is desirably $\lambda/4$ (a quarter of the operating wavelength), where $\lambda$ is the wavelength with respect to the operating frequency. Furthermore, it is desirable that the length obtained by subtracting the radius of the first hole 6 from the radius of the disk 5 be $\lambda/4$.

Note that the distance between the disk 5 and the ground conductor 1 may be within $\lambda/4$, which is the limit considered as a transmission path, and is desirably $\lambda/10$ (1/10 of the operating wavelength).

The first hole 6 is provided in the ground conductor 1 so that the vertical conductor 4 does not contact the ground conductor 1. Desirably, the cross section of the first hole 6 is circular, and the central axis of the vertical conductor 4 passes through the center of the first hole 6. Thus, a coaxial line having the vertical conductor 4 as the inner conductor and the ground conductor 1 as the outer conductor is formed.

The second hole 7 is provided in the disk 5 so that the vertical conductor 4 does not contact the disk 5. Desirably, the cross section of the second hole 7 is circular, and the vertical axis passing through the center of the disk 5 and the vertical axis passing through the center of the second hole 7 coincide with each other. As in the case of the first hole 6, it is desirable that the central axis of the vertical conductor 4 passes through the center of the second hole 7.

Next, the operation of the antenna device according to the present embodiment will be described. Since reversibility is satisfied between a transmission antenna and a receiving antenna, only the operation as the transmission antenna will be described here.

When a high-frequency voltage is applied between the vertical conductor 4 and the ground conductor 1 by a power feeding circuit (not illustrated), movement of charges occurs in both, and an alternating current flows. As a result, a high-frequency current flows through the circular polarization element antenna 2 via the vertical conductor 4 and the horizontal conductor 3, and radiates a circularly polarized wave.

Figure 3:
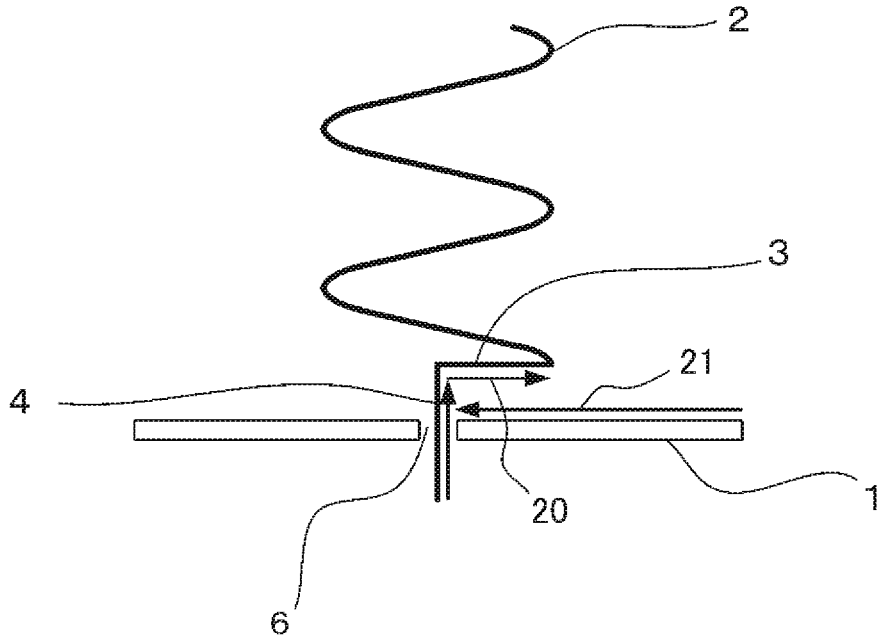
FIG. 3 is a diagram illustrating a distribution of a current 21 induced by a current 20 flowing through a horizontal conductor 3 in the antenna device (without a disk 5) according to the first embodiment.

The effect of the disk 5 will be described with reference to FIGS. 3 and 4. FIG. 3 is a cross-sectional view illustrating the configuration of the circular polarization element antenna when the disk 5 is not provided, and FIG. 4 is a cross-sectional view illustrating the configuration of the circular polarization element antenna when the disk 5 is provided.

Figure 4:
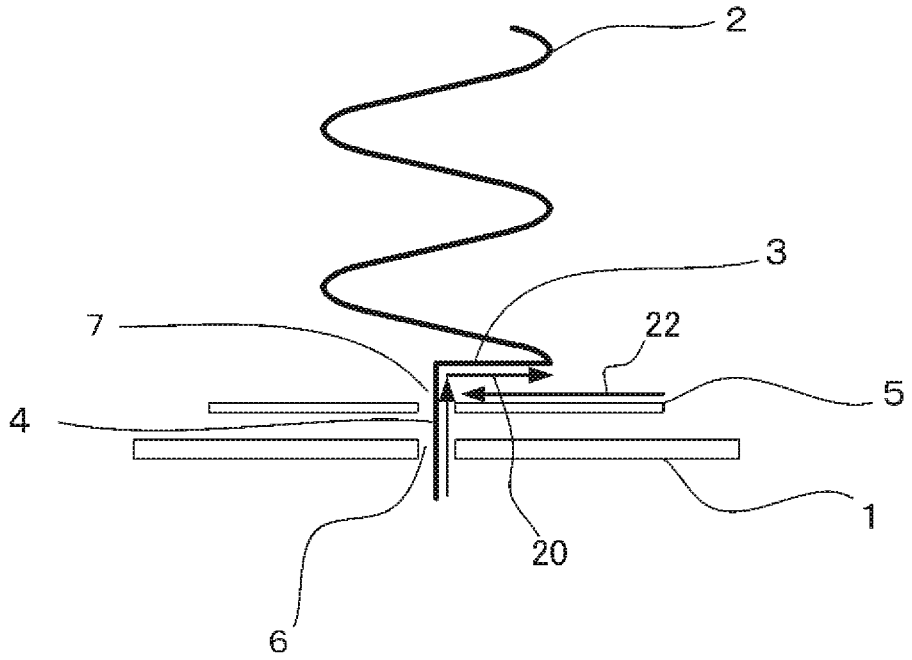
FIG. 4 is a diagram illustrating a distribution of a current 22 induced by a current 20 flowing through the horizontal conductor 3 in the antenna device (with the disk 5) according to the first embodiment.

In FIGS. 3 and 4, the same reference numerals as those in FIG. 1 indicate the same or corresponding parts.

In FIGS. 3 and 4, reference numeral 20 denotes a current flowing from the vertical conductor 4 to the horizontal conductor 3, and reference numerals 21 and 22 denote currents induced by the current 20.

First, the operation when the disk 5 is not provided will be described.

In FIG. 3, since the radiation from the current flowing through the vertical conductor 4 deteriorates the circular polarization characteristics of the circular polarization element antenna 2, it is desirable that the length of the vertical conductor 4 protruding from the ground conductor 1 be reduced as much as possible. However, when the length of the vertical conductor 4 protruding from the ground conductor 1 is reduced, the horizontal conductor 3 and the ground conductor 1 are close to each other, so that the current 21 induced by the current 20 flowing through the horizontal conductor 3 flows on the ground conductor 1.

In other words, a strong electric field is generated between the horizontal conductor 3 and the ground conductor 1, which affects the circular polarization characteristics of the circular polarization element antenna 2. For this reason, the shape of the ground conductor 1 and the relative position between the ground conductor 1 and the circular polarization element antenna 2 need to be adjusted based on the situation in which they are used.

Therefore, when the antenna is installed, if the shape of the ground conductor 1 changes or the relative position between the ground conductor 1 and the circular polarization element antenna 2 changes, the previously designed circular polarization characteristics cannot be obtained.

On the other hand, in the antenna device according to the first embodiment of the present invention, the disk 5 is added between the ground conductor 1 and the horizontal conductor 3, as illustrated in FIG. 4.

Since the distance between the disk 5 and the ground conductor 1 is equal to or less then $\lambda/4$ and sufficiently smaller than the wavelength $\lambda$ with respect to the operating frequency, the space between the disk 5 and the ground conductor 1 can be regarded as a radial line waveguide.

Further, since the radius of the disk 5 is set to $\lambda/4$, the impedance when viewing the ground conductor 1 from the disk 5 is very high, and the current from the disk 5 to the ground conductor 1 is cut off.

As illustrated in FIG. 4, the current 22 induced by the current flows on the disk 5 and does not flow to the ground conductor 1. Therefore, even if the shape of the ground conductor 1 changes or the relative position between the circular polarization element antenna 2 and the ground conductor 1 changes, the circular polarization characteristics of the antenna are not affected.

As described above, by designing the circular polarization element antenna 2 under the condition that the disk 5 is provided, the antenna device in which the circular polarization characteristics are less deteriorated with respect to a change in the antenna installation conditions or a manufacturing error can be obtained.

Next, results of an electromagnetic field simulation will be described to explain the effect of the disk 5 of the antenna device according to the present embodiment.

Figure 5:
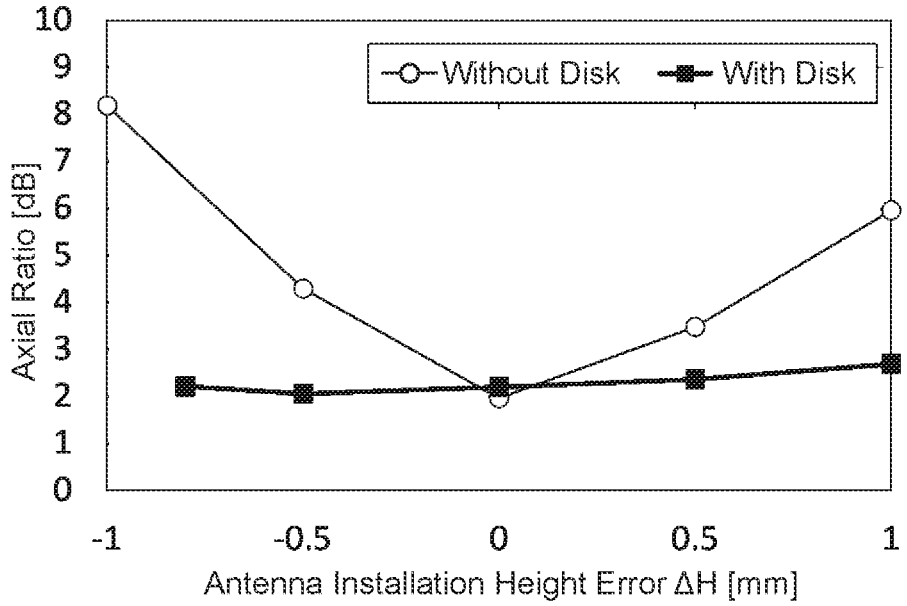
FIG. 5 is a graph illustrating an axial change in an axial ratio of the circular polarization element antenna 2 with respect to an error ΔH of an antenna installation height of the antenna device according to the first embodiment.

FIG. 5 is a graph illustrating, an axial change in the axial ratio of the circular polarization element antenna 2 with respect to a variation in the distance between the ground conductor 1 and the horizontal conductor 3 that is, the antenna installation height error $\Delta H$. The calculated frequency is 12 GHz.

When the disk 5 is not provided, the axial ratio is 2.0 dB when $\Delta H=0$ (according to the design dimensions), whereas the axial ratio has deteriorated to 4.2 dB when $\Delta H=-0.5$ mm, and it can be seen that a slight error greatly deteriorates the circular polarization characteristics.

On the other hand, when the disk 5 is provided, even when $\Delta H=\pm 1$ mm, the variation of the axial ratio is only $\pm 0.5$ dB, and it can be confirmed that the variation of the circular polarization characteristics can be reduced.

As described above, in the antenna device according to the present embodiment, the disk 5 having a radius of a quarter of the wavelength with respect to the operating frequency is provided between the circular polarization element antenna 2, which is a helical antenna, and the ground conductor 1. With this configuration, the current induced on the ground conductor 1 due to the current flowing on the horizontal conductor 3 can be suppressed, and the deterioration of the circular polarization characteristics can be suppressed with respect to a change in the antenna installation conditions or a manufacturing error.

Second Embodiment

In the first embodiment, the case where the disk 5 is provided between the ground conductor 1 and the circular polarization element antenna 2 has been described. In the present embodiment, a case where a short-circuit conductor (third conductor) 8 is newly provided between the ground conductor 1 and the disk 5 will be described.

Figure 6:
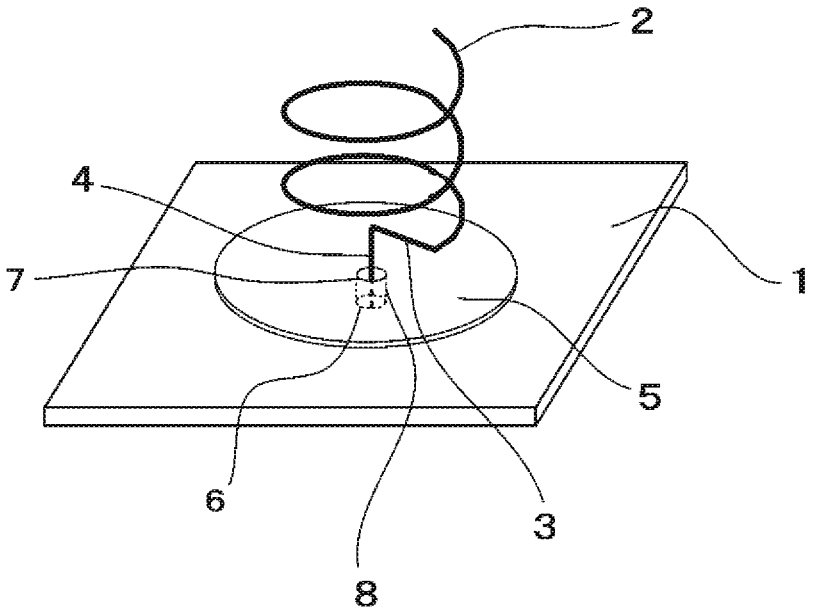
FIG. 6 is a configuration diagram illustrating an antenna device according to a second embodiment.
Figure 7:
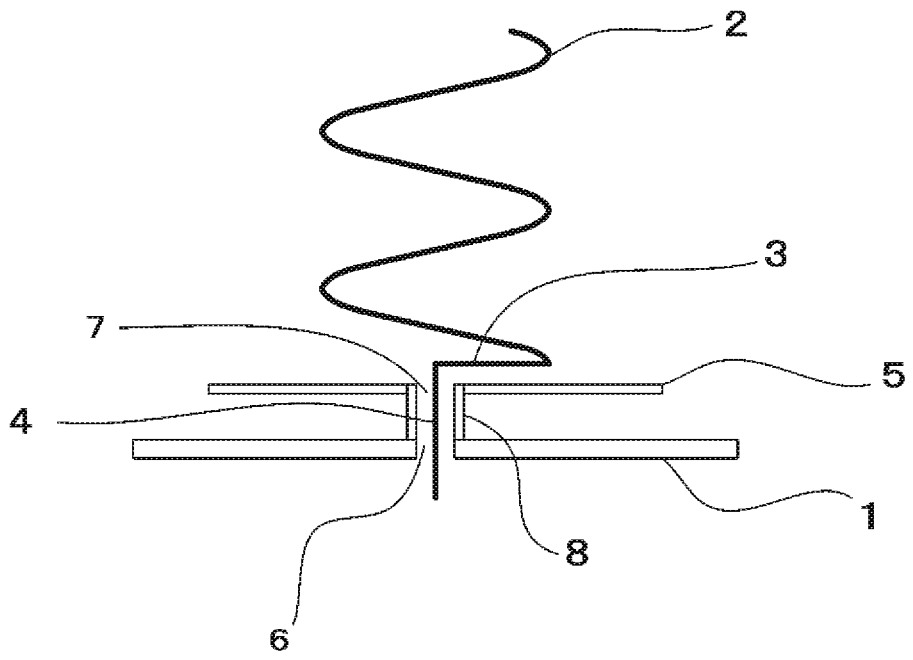
FIG. 7 is a cross-sectional view illustrating the antenna device according to the second embodiment.

FIG. 6 is a configuration diagram illustrating the antenna device according to the present embodiment. In FIG. 6, the same components as those in the first embodiment are denoted by the same reference numerals, and description thereof will be omitted. FIG. 7 is a cross-sectional view of a plane including the vertical conductor 4 and perpendicular to the ground conductor 1.

The difference between the antenna device according to the present embodiment and the antenna device according to the first embodiment is that a short-circuit conductor 8 for electrically connecting the disk 5 and the ground conductor 1 is newly provided.

The short-circuit conductor 8 is a cylindrical conductor disposed along the edge of the second hole 7 provided in the disk 5. The upper end and the lower end of the short-circuit conductor 8 are electrically connected to the disk 5 and the ground conductor 1, respectively.

Next, the operation of the antenna device according to the present embodiment will be described. Basically, the operation is the same as the operation described in the first embodiment. However, in the case of the antenna device according to the present embodiment, a choke structure is formed by not only the disk 5 and the ground conductor 1 but also the short-circuit conductor 8. As a result, the current flowing from the horizontal conductor 3 to the ground conductor 1 can be more effectively cut off. By using the short-circuit conductor 8 in addition to the disk 5 as described above, it is possible to obtain an antenna device in which the circular polarization characteristics of the circular polarization element antenna 2 are further improved as compared with the case where only the disk 5 is used, and the deterioration of the circular polarization characteristics is small with respect to the change in the antenna installation conditions and the manufacturing error.

Figure 8:
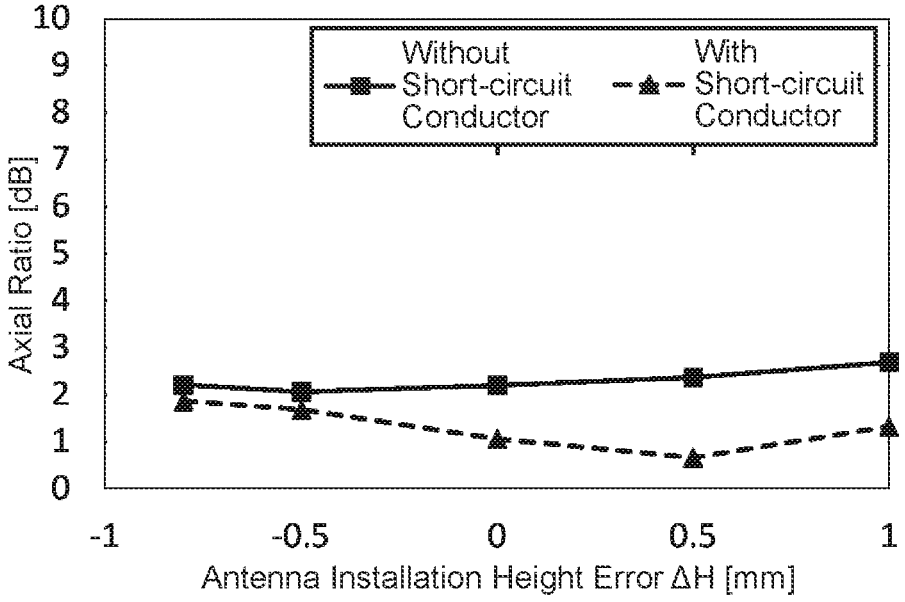
FIG. 8 is a graph illustrating an axial change in an axial ratio of a circular polarization element antenna 2 with respect to an error ΔH in the antenna installation height of the antenna device according to the second embodiment.

FIG. 8 shows the result of an electromagnetic field simulation to explain the effect of the choke structure of the antenna device according to the present embodiment.

FIG. 8 is a graph illustrating an axial change in the axial ratio of the circular polarization element antenna 2 with respect to a variation in the distance between the ground conductor 1 and the horizontal conductor 3, that is, the antenna installation height error $\Delta H$.

As described in the first embodiment, by providing the disk 5, even if ΔH=±1 mm, the deterioration amount of the axial ratio is ±0.5 dB or less, and the variation of the circular polarization characteristics can be reduced. On the other hand, when the short-circuit conductor 8 is added to the disk 5, it can be seen that the absolute value of the axial ratio is smaller than when the short-circuit conductor 8 is not provided, and the circular polarization characteristics are improved. The variation of the axial ratio with respect to ΔH is ±0.7 dB is almost the same as when the short-circuit conductor 8 is not provided.

As described above, in the antenna device according to the present embodiment, by newly providing the short-circuit conductor 8 for electrically connecting the disk 5 and the ground conductor 1, it is possible to obtain an antenna device in which the deterioration of the circular polarization characteristics is small with respect to the change in the antenna installation conditions and the manufacturing error.

Third Embodiment

In the second embodiment, a case of reducing the deterioration of the circular polarization characteristics with respect to the change in the antenna installation conditions and the manufacturing error by newly providing the short-circuit conductor 8 between the ground conductor 1 and the disk 5 has been described.

In this embodiment, a case of providing a support member will be described.

Figure 9:
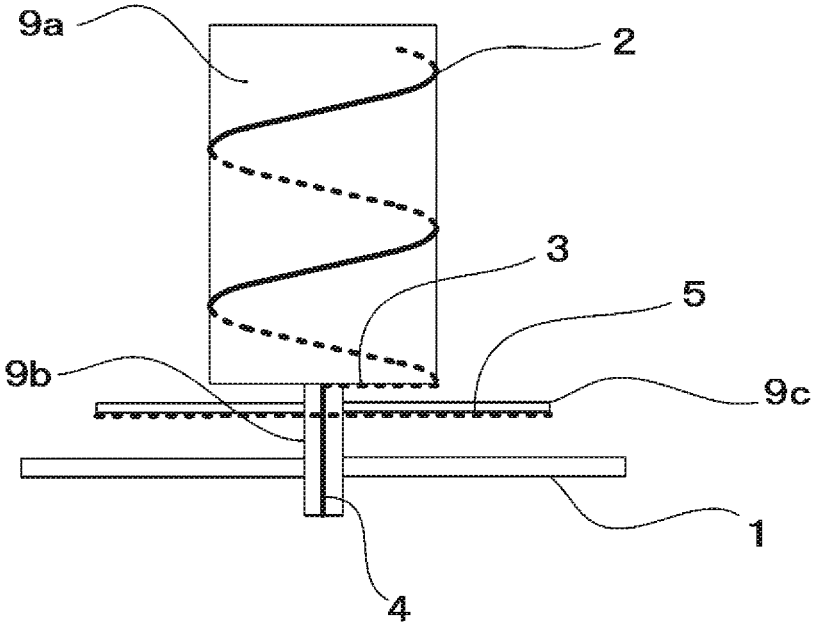
FIG. 9 is a cross-sectional view illustrating an antenna device according to a third embodiment.

FIG. 9 is a cross-sectional view of the antenna device according to the embodiment of the present invention. In FIG. 9, reference numeral 9*a* is a support member (first dielectric) for fixing the circular polarization element antenna 2, 9*b* is a support member (second dielectric) for fixing the vertical conductor 4, and 9*c* is a support member (third dielectric) for fixing the disk 5.

In FIG. 9, the same components as those in the first and second embodiments are denoted by the same reference numerals, and description thereof will be omitted. FIG. 9 is a cross-sectional view of a plane including the vertical conductor 4 and perpendicular to the ground conductor 1.

The difference between the antenna device according to the present embodiment and the antenna device according to the first embodiment is that support members for supporting the circular polarization element antenna 2, the vertical conductor 4, and the disk 5 are newly provided.

The material of the support members 9*a* to 9*c* is desirably a dielectric such as polytetrafluoroethylene (PTFE). If the antenna is designed according to the material used, the material used as the support member may be appropriately selected.

The support member 9*a* desirably has a columnar shape so that the circular polarization element antenna 2 can be fixed to a side surface of the support member 9*a*.

Figure 10:
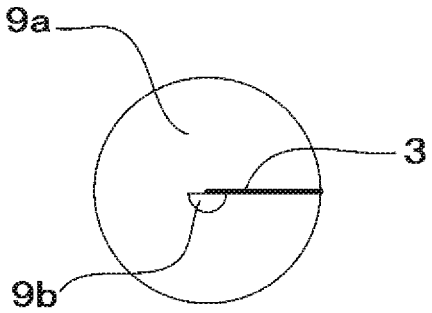
FIG. 10 is a schematic diagram illustrating a bottom surface of a support member 9*a* of the antenna device according to the third embodiment.

FIG. 10 is a schematic diagram illustrating the bottom surface of the support member 9*a*. Note that the support member 9*c* is omitted from FIG. 10 for easy intelligibility.

The horizontal conductor 3 can be fixed to the bottom surface of the support member 9*a* as illustrated in FIG. 10. Other than the above, as in the first embodiment, one end of the horizontal conductor 3 is connected to the lower end of the circular polarization element antenna 2 and the other end is connected to the vertical conductor 4.

Figure 11:
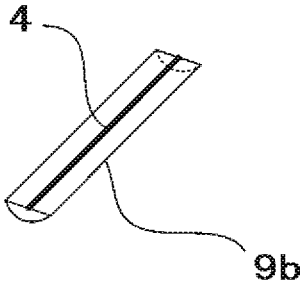
FIG. 11 is a schematic diagram illustrating a structure of a support member 9*b* of the antenna device according to the third embodiment.

FIG. 11 is a schematic diagram illustrating the structure of the support member 9*b*. The support member 9*b* has, for example, a shape formed by dividing a cylinder into half by a plane including the central axis thereof, so that the vertical conductor 4 can be fixed along the central axis of the cylinder. Other than the above, as in the first embodiment, one end of the vertical conductor 4 is connected to the other end of the horizontal conductor 3, and the other end of the vertical conductor 4 is connected to a power feeding line (not illustrated).

The support member 9*b* and the vertical conductor 4 are arranged so that a part thereof passes through the first hole 6 of the ground conductor 1. Naturally, the first hole 6 has a size that does not contact the ground conductor 1 when the support member 9*b* rotates. The support member 9*b* is fixed to the bottom surface of the support member 9*a* so that the central axis of the support member 9*b* coincides with the central axis of the support member 9*a*. The support member 9*b* may be formed integrally with the support member 9*a*.

The support member 9*c* is a plate-shaped dielectric fixed to the support member 9*b* at a predetermined distance from the ground conductor 1 perpendicular to the central axis of the support member 9*b*. The disk 5 can be fixed to the bottom surface of the support member 9*c*. A third hole is provided at the center of the support member 9*c* so that the support member 9*b* can rotate without contact. The outer periphery of the support member 9*c* is desirably circular, and the central axis of the support member 9*c* coincides with that of the support member 9*b* and that of the support member 9*a*.

Note that the size of the third hole may be set to a size that the support member 9*b* just passes, thereby fixing the support member 9*b* and the support member 9*c*. Further, the support member 9*c* may be formed integrally with the support member 9*b*.

In addition, the methods of fixing each support member to the circular polarization element antenna 2, the horizontal conductor 3, the vertical conductor 4, and the disk 5 may include a method of winding a film substrate on which a conductor pattern is formed, and a method of forming a conductor pattern by plating, vapor deposition, or the like.

For example, the film substrate on which the conductor pattern of the circular polarization element antenna 2 and the horizontal conductor 3 is formed is wound around the support member 9*a*, the film on which the conductor pattern of the vertical conductor 4 is formed is attached to the support member 9*b*, and plating may be performed on the support member 9*c* so as to form a conductor pattern of the disk 5.

As described above, by fixing the circular polarization element antenna 2, the horizontal conductor 3, the vertical conductor 4, and the disk 5 with the support members, as in the case of the first and second embodiments, it is possible to block the current induced by the current on the horizontal conductor 3 from flowing through the ground conductor 1. In addition, even if a change in the antenna installation conditions or a manufacturing error occurs, such as a change in the shape of the ground conductor 1 or a change in the relative position between the circular polarization element antenna 2 and the ground conductor 1, the deterioration of the circular polarization characteristics can be suppressed.

Another effect of the present embodiment is that the manufacturing accuracy of the circular polarization element antenna 2 is improved. If the distance between the horizontal conductor 3 and the disk 5 changes during the manufacturing process, the amplitude and phase of the current induced in the disk 5 by the current on the horizontal conductor 3 will change, and the influence on the circular polarization characteristics of the circular polarization element antenna 2 is not stable. However, in the embodiment of the present invention, since the support members 9*b* and 9*c* are fixed, the distance between the horizontal conductor 3 and the disk 5 can be kept constant. That is, it is possible to suppress variations in manufacturing the antenna device.

Fourth Embodiment

In the first to third embodiments, the case of treating the antenna device as a single unit has been described. In this embodiment, a case of forming an array antenna in which a plurality of antenna devices are formed (are arranged) will be described.

In the antenna device used in the array antenna device according to the present embodiment, any one of the configurations of the antenna devices described in the first to third embodiments is used as the configuration of an element antenna of the array antenna, a plurality of the element antennas are appropriately arranged, and power is fed thereto, thus configuring an array antenna.

Figure 12:
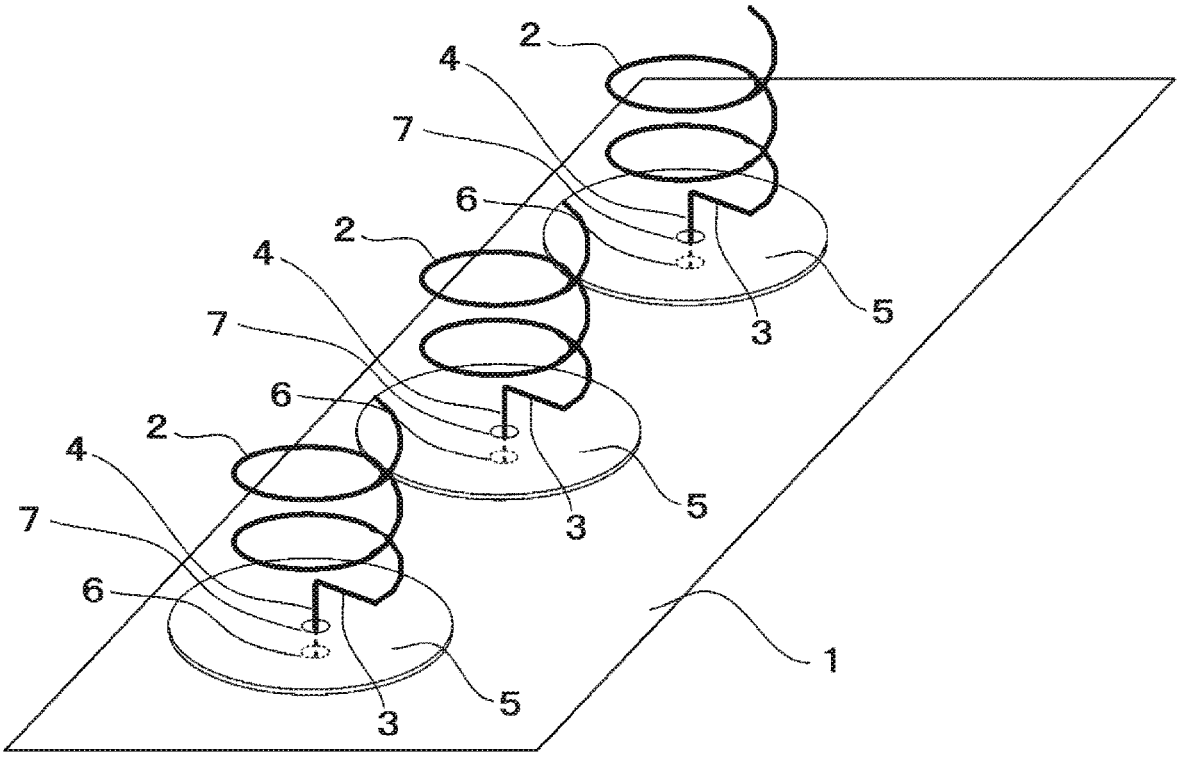
FIG. 12 is a diagram illustrating an example of a configuration of an array antenna device in which antenna devices are arranged linearly with respect to a ground conductor 1.

FIG. 12 illustrates an example of the configuration of the array antenna device according to the present embodiment.

The example of FIG. 12 illustrates a linear array antenna in which element antennas of the array antenna are linearly arranged.

Figure 13:
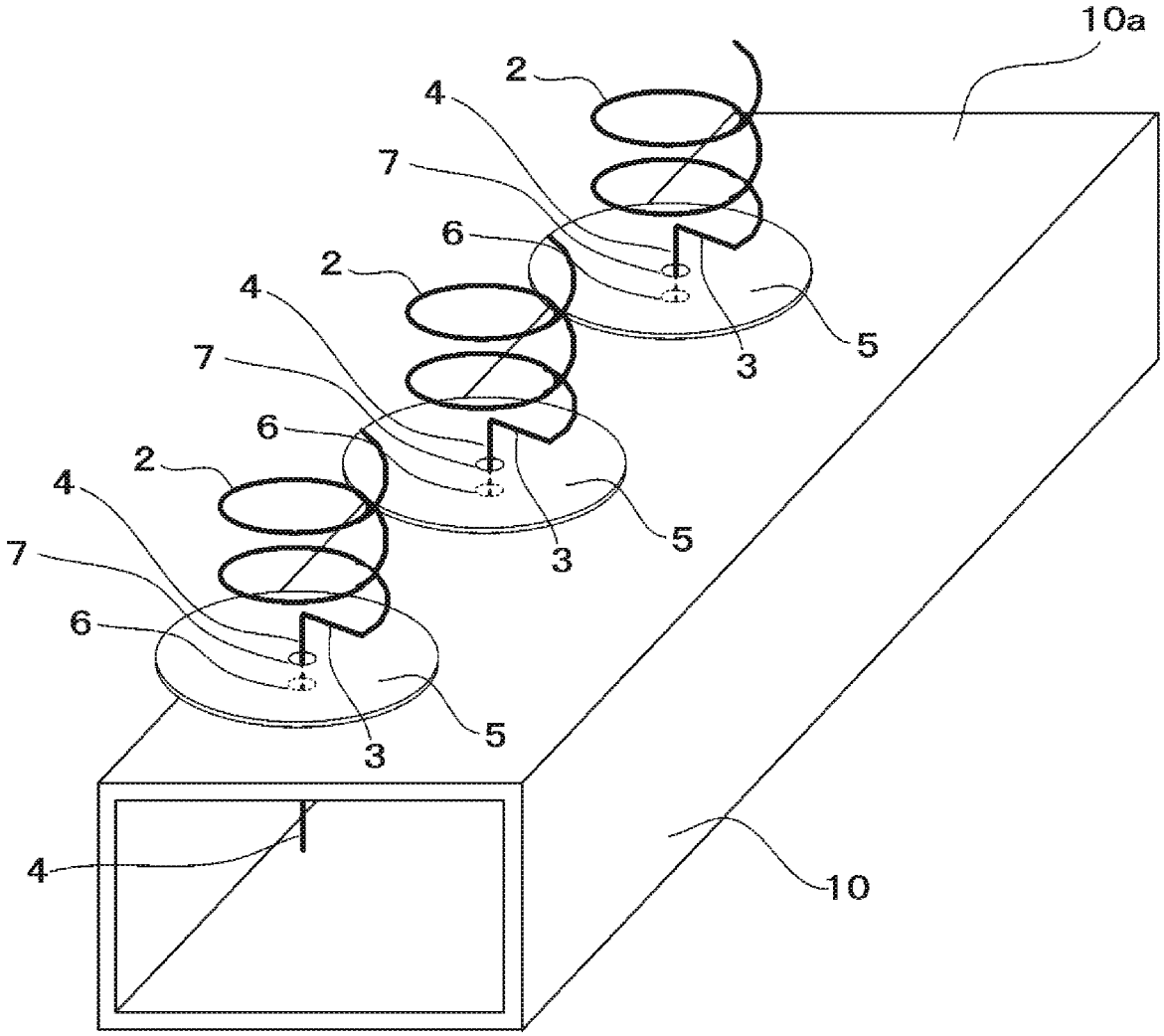
FIG. 13 is a diagram illustrating an example of a configuration of an array antenna device in which the antenna devices are arranged linearly on one surface of a waveguide 10 with respect to a central axis of the waveguide.

FIG. 13 is an explanatory diagram illustrating another example of the configuration of the array antenna. In FIG. 13, reference numeral 10 denotes a waveguide (waveguide tube), and 10*a* denotes one surface of the waveguide 10. The first surface 10*a* of the waveguide 10 corresponds to the ground conductor 1 in FIG. 12. Therefore, the hole provided in the first surface 10*a* is also referred to as the first hole 6.

In FIG. 13, the vertical conductor 4 extends through the hole 6 provided in the first surface 10*a* of the waveguide 10 to the inside of the waveguide 10.

When a high-frequency voltage is applied to the waveguide 10, the electric field inside the waveguide 10 is coupled to the vertical conductor 4, and a current is generated in the vertical conductor 4. Thereby, electric power is supplied to the circular polarization element antenna 2 to radiate a circularly polarized wave.

At this time, the phase difference between elements of the circularly polarized wave radiated from each circular polarization element antenna 2 is determined by the phase difference between the current flowing through each vertical conductor 4 and the difference between the physical rotation angles with respect to the reference angle of each circular polarization element antenna 2.

As described above, any one of the configurations of the antenna devices described in the first to third embodiments is used as the configuration of the element antenna of the array antenna, a plurality of the element antennas are appropriately arranged on one surface of the waveguide, and a power is fed thereto. This makes it possible to perform directivity synthesis by arraying, and to achieve desired radiation characteristics.

Figure 14:
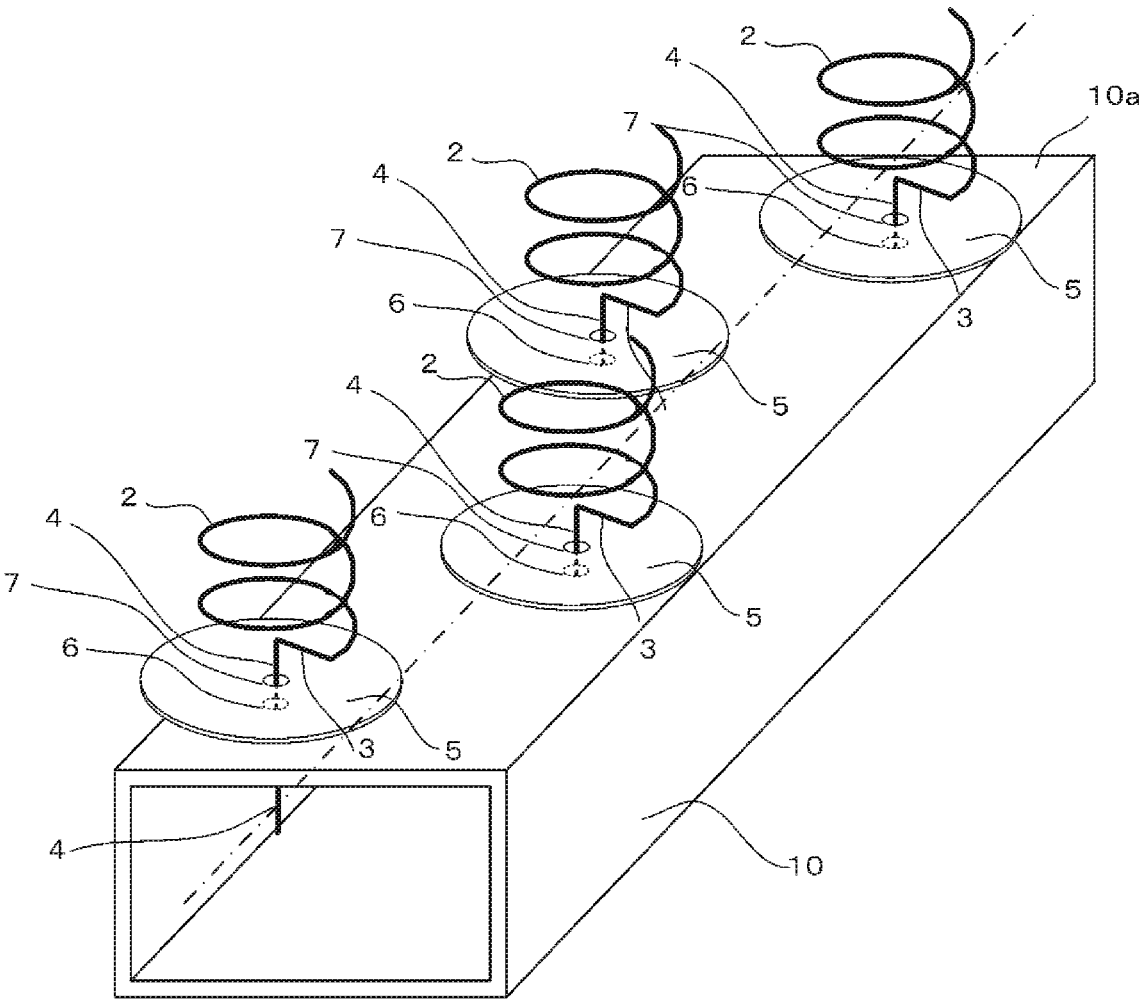
FIG. 14 is a diagram illustrating an example of a configuration of an array antenna device in which antenna devices are alternately arranged on one surface of the waveguide 10 with respect to a central axis of the waveguide.

Although the fourth embodiment illustrates an example in which the plurality of circular polarization element antennas 2 are arranged at equal intervals on one side of the tube axis center line of the waveguide 10, this is merely an example. For example, as illustrated in FIG. 14, adjacent circular polarization element antennas 2 may be arranged so as to be arranged at positions opposite to each other with the tube axis center line interposed therebetween.

Further, the adjacent circular polarization wave element antennas 2 may be arranged so that the interval between the adjacent circular polarization element antennas 2 is different.

Also, the plurality of circular polarization element antennas 2 may be arranged at arbitrary positions as long as they do not contact each other, that is, do not physically interfere with each other.

In the present embodiment, an example is illustrated in which the insertion lengths of the plurality of vertical conductors 4 inside the waveguide 10 are all the same length. However, as long as the length is determined on the basis of the excitation amplitude distribution as an array antenna for obtaining a desired radiation pattern and the impedance characteristics of the waveguide 10 at the power feeding end, each of the vertical conductors 4 may have a different length.

Fifth Embodiment

In the fourth embodiment, a case has been described in which any one of the configurations of the antenna devices described in the first to third embodiments is used as the configuration of the element antenna of the array antenna, a plurality of the element antennas are appropriately arranged on one surface of the waveguide, and a power is fed thereto. In the present embodiment, a case will be described in which the circular polarization element antennas 2 can be individually controlled.

Figure 15:
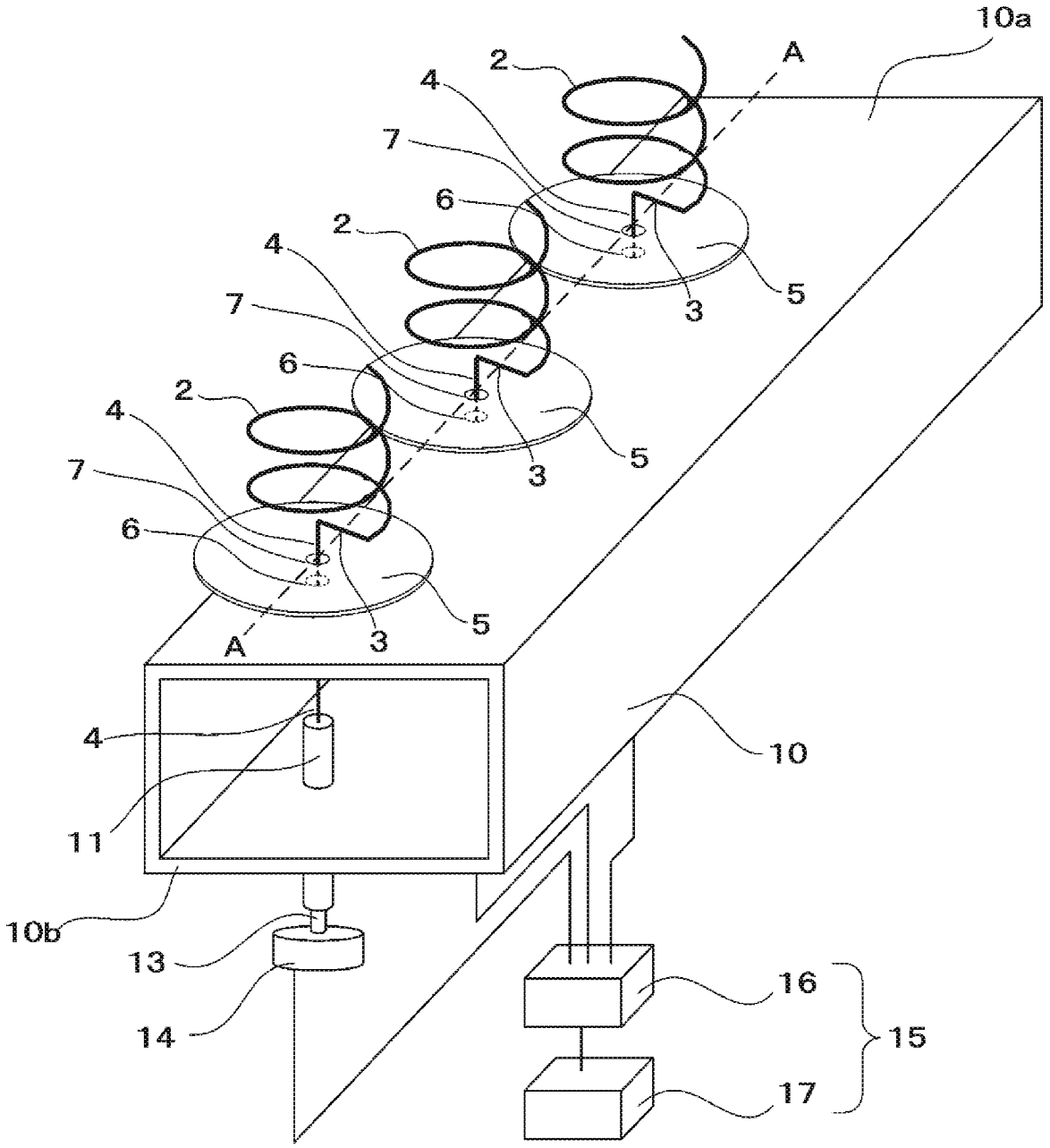
FIG. 15 is a configuration diagram illustrating an array antenna device according to a fifth embodiment.
Figure 16:
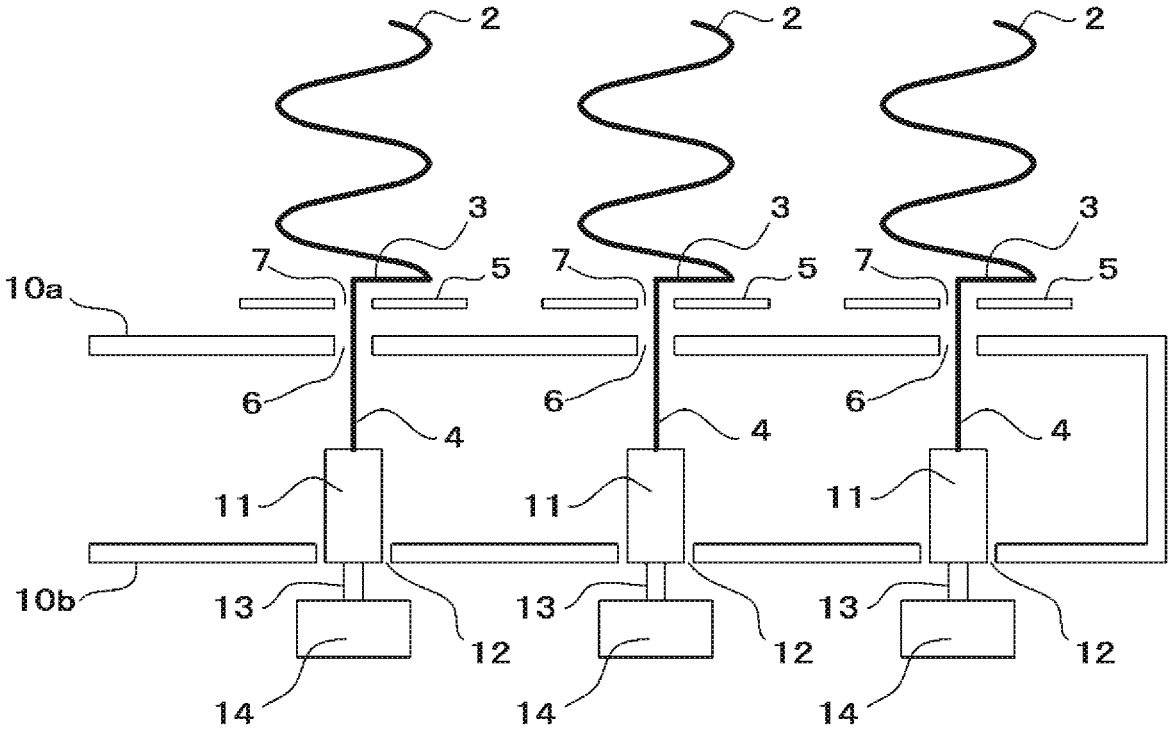
FIG. 16 is a cross-sectional view illustrating the array antenna device according to the fifth embodiment.

FIG. 15 is a configuration diagram illustrating an antenna device according to a fifth embodiment of the present invention. FIG. 16 is a cross-sectional view taken along line A-A of the antenna device of FIG. 15. In FIGS. 15 and 16, the same components as those in FIGS. 1 to 14 are denoted by the same reference numerals, and description thereof will be omitted.

In FIGS. 15 and 16, reference numeral 11 denotes a connection shaft, 12 denotes a connection shaft insertion hole (fourth hole), 13 denotes a rotary shaft, 14 denotes a rotation device, and 15 denotes a control device. Reference numeral 10*b* denotes a second surface facing the first surface 10*a* of the waveguide 10 in parallel. Reference numeral 16 denotes a rotation drive device provided in the control device 15, and reference numeral 17 denotes a rotation control device provided in the control device 15.

The connection shaft 11 is formed of an insulator such as a dielectric, for example. The connection shaft 11 is inserted so that one end thereof passes through the connection shaft insertion hole 12 provided in the second surface 10*b* facing the first surface 10*a* of the waveguide 10, and the other end is connected to a lower end of the vertical conductor 4.

As a method of connecting the connection shaft 11 and the vertical conductor 4, for example, a method of screwing the connection shaft 11 and the vertical conductor 4 by providing a screw hole in the connection shaft 11 and providing a male screw in the vertical conductor is conceivable. Further, a method of providing a fitting hole in the connection shaft 11 and press-fitting the vertical conductor 4 into the fitting hole is conceivable. Further, a method of forming a conductor pattern constituting the vertical conductor 4 on the connection shaft 11 is conceivable.

The connection shaft insertion hole 12 is a hole formed in the surface 10*b* of the waveguide 10 so that the connection shaft 11 can loosely pass through. The diameter of the connection shaft insertion hole 12 is larger than that of the connection shaft 11, but desirably it is sufficiently smaller than the wavelength of the high-frequency signal propagating in the waveguide 10. Similarly, it is desirable that the diameter of the first hole 6 formed so that the vertical conductor 4 can pass loosely through the surface 10*a* of the waveguide 10 is also sufficiently smaller than the wavelength of the high-frequency signal propagating in the waveguide 10.

The rotary shaft 13 is formed of a metal conductor, and has one end connected to the other end of the connection shaft 11 and the other end connected to the rotation device 14. The connection method between the rotary shaft 13 and the connection shaft 11 is the same as the connection method between the vertical conductor 4 and the connection shaft 11. The connection position between the rotary shaft 13 and the connection shaft 11 is outside the waveguide 10.

The rotation device 14 is implemented by, for example, an electric motor such as a DC motor, an AC motor, and a stepping motor. Rotating the rotary shaft 13 by the rotation device 14 rotates the circular polarization element antenna 2 via the connection shaft 11 and the vertical conductor 4 connected to the rotary shaft.

The control device 15 includes the rotation drive device 16 and the rotation control device 17, and is a device that individually controls the rotation of the plurality of rotation devices 14.

The rotation drive device 16 is, for example, a motor driver implemented by a semiconductor integrated circuit, a network interface such as a communication device, a power supply circuit, a drive current generation circuit, and the like.

The rotation drive device 16 outputs a drive current corresponding to a command value output from the rotation control device 17 to the rotation device 14, thereby driving the rotation device 14 so that the rotary shaft 13 rotates to a predetermined angle.

The rotation control device 17 includes, for example, a storage device such as a RAM (Random Access Memory) or a hard disk, a semiconductor integrated circuit or a one-chip microcomputer mounting a CPU (Central Processing Unit), a user interface such as a keyboard or a mouse, and a network interface such as a communication device.

The rotation control device 17 calculates, for example, a rotation angle or the like of the rotary shaft 13 on the basis of information input by the user interface or information stored in the storage device, and outputs a command value indicating the calculated rotation angle or the like to the rotation drive device 16 through the network interface.

The rotation drive device 16 that has received the command value output from the rotation control device 17 outputs a drive current corresponding to the command value output from the rotation control device 17 to the rotation device 14, thereby driving the rotation device 14 so that the rotary shaft 13 rotates to a predetermined angle.

In the present embodiment, the control device 15 is described as being divided into the rotation drive device 16 and the rotation control device 17, but only the control device 15 having both functions may be used.

Further, in the present embodiment, the case where the connection shaft 11 and the rotation device 14 are connected via the rotary shaft 13 has been described, but the connection shaft 11 and the rotation device 14 may be directly connected.

Further, if there is no problem in the design of the antenna device, the vertical conductor 4 and the rotation device 14 may be directly connected not only without using the rotary shaft 13 but also without using the connection shaft.

As described in the fourth embodiment, when a high-frequency voltage is applied to the waveguide 10, the internal electric field of the waveguide 10 is coupled to the vertical conductor 4, and a current is generated in the vertical conductor 4. Thereby, electric power is supplied to the circular polarization element antenna 2 to radiate a circularly polarized wave. At this time, the phase difference of the circularly polarized wave radiated from each circular polarization element antenna between elements is determined by the phase difference between the current flowing through each vertical conductor 4 and the difference between the physical rotation angles with respect to the reference angle of each circular polarization element antenna 2.

Each circular polarization element antenna 2 is connected to each rotary shaft 13 via the vertical conductor 4 and the connection shaft 11, and each rotary shaft 13 is connected to each rotation device 14. Therefore, the control device 15 can individually control the rotation angles of the respective circular polarization element antennas 2 by individually controlling the respective rotation devices 14. This means that the excitation phases of the element antennas can be individually controlled.

As described above, the rotation devices 14 are connected to the vertical conductors 4 connected to the respective circular polarization element antennas 2 via the connection shafts 11 and the rotary shafts 13, the respective rotation devices 14 are controlled simultaneously by the control device 15, thereby an active phased array antenna can be configured, and desired directivity control can be performed.

Further, as described in the first to third embodiments, in the antenna device according to the present embodiment as well, by providing the disk 5 having a radius of a quarter of the wavelength with respect to the operating frequency between the circular polarization element antenna 2, which is a helical antenna, and the first surface 10*a* of the waveguide 10, it is possible to suppress a current induced on the first surface 10*a* of the waveguide 10 by the current flowing on the horizontal conductor 3 and to suppress the deterioration of the circular polarization characteristics with respect to a change in the antenna installation conditions and a manufacturing error.

Generally, the position of the rotary shaft of the electric motor slightly varies. However, by configuring the disk 5 described above, it is possible to reduce the deterioration of the circular polarization characteristics with respect to a change in the antenna installation conditions or a manufacturing error. Therefore, an active phased array antenna having good circular polarization characteristics can be obtained.

In the first to fifth embodiments, the shape of the disk 5 may be appropriately hollowed out or modified as long as the operation does not change.

The invention claimed is:

1. An array antenna device comprising:

a waveguide having a plurality of first circular holes provided in a first surface, and a plurality of connection shaft insertion holes provided in a second surface facing the first surface;

a plurality of first linear conductors respectively inserted into the plurality of first holes so that first ends are arranged inside the waveguide and second ends are arranged outside the waveguide;

a plurality of disc-shaped conductor plates each having a second circular hole and disposed substantially parallel to the first surface outside the waveguide so that the plurality of first linear conductors are respectively inserted into the second holes;

a plurality of second linear conductors having first ends respectively connected to second ends of the plurality of first linear conductors and arranged substantially parallel to the first surface;

a plurality of antenna elements respectively connected to second ends of the plurality of second linear conductors;

a plurality of connection shafts respectively inserted into the plurality of connection shaft insertion holes and having first ends respectively connected to first ends of the plurality of first linear conductors;

a plurality of rotators to rotate each of the plurality of connection shafts; and a controller to individually control rotation of the plurality of rotators.

* * * * *